United States Patent [19]

Suzuki

[11] 4,237,784

[45] Dec. 9, 1980

[54] DATING MACHINE IMPRESSING A DATE ON CALLING CARDS, BUSINESS CARDS OR THE LIKE

[76] Inventor: Kisaburo Suzuki, 23-5, Shibamata 4-chome Katsushika-ku, Tokyo, Japan

[21] Appl. No.: 7,309

[22] Filed: Jan. 29, 1979

[51] Int. Cl.[3] ..... B41F 1/02; B41J 3/24; B41J 1/28; B41K 3/26

[52] U.S. Cl. ..... 101/20; 101/29; 101/30; 400/134.4; 400/138.4; 400/138.6

[58] Field of Search ..... 400/132, 134, 134, 4.13 S, 400/137, 138, 138.1, 138.2, 138.4, 138.5, 138.6; 101/18, 19, 20, 29, 30

[56] References Cited

U.S. PATENT DOCUMENTS

| | | | |
|---|---|---|---|
| 1,423,236 | 7/1922 | McCombs | 101/19 |
| 1,574,830 | 3/1926 | McCombs | 101/20 |
| 1,627,619 | 5/1927 | Reubens | 101/19 |
| 1,634,105 | 6/1927 | Hoffman | 101/20 |
| 1,709,106 | 4/1929 | Abramson | 101/20 |
| 1,737,136 | 11/1929 | Zapanta | 101/20 |
| 1,998,063 | 4/1935 | Wessborg | 101/18 |
| 2,826,987 | 3/1958 | Eckhoff | 101/19 |
| 3,393,636 | 7/1968 | Tobin | 101/20 |
| 3,828,664 | 8/1974 | Dikoff | 101/19 |

*Primary Examiner*—William Pieprz
*Attorney, Agent, or Firm*—Wills, Green & Mueth

[57] ABSTRACT

A machine for impressing a data on calling cards, business cards or the like, having a plurality of data elements mounted to a base plate for independent movement relative thereto between conditions of aligment corresponding to individual calendar dates. The elements carry projections corresponding to the days, months and years of the calendar dates, and means are provided for pressing a card against the elements when they are in one of the conditions of alignment to form indentations indicating the corresponding calendar date.

4 Claims, 11 Drawing Figures

DATING MACHINE IMPRESSING A DATE ON CALLING CARDS, BUSINESS CARDS OR THE LIKE

BACKGROUND OF THE INVENTION

The present invention relates to a dating machine which presses a set of indentations indicating a date into calling cards, business cards or the like. More specifically, the invention relates to a dating machine which is pocketable and can be conveniently carried together with or received into a card case and used anywhere.

BACKGROUND OF THE INVENTION

It is often necessary to make note of a date when something should be done or has been done. Particularly in the case of businessmen or salesmen, the necessity for making note of a date may frequently arise, and failure to take the required action on the date may have serious business consequences.

In practice, the appointed date is often noted by handwriting it on a business card presented at a meeting. As the card having the date written thereon is received into a card case or other receptacle and rubbed by other cards, the date is apt to be smeared or become so pale as to be illegible. The appointed date might then be missed.

It is also sometimes desired to note the date on which a card was presented for the purpose of later placing many such cards in chronological order. However, there is no presently available means for conveniently noting dates on business cards as they are received.

In practice some businessmen have sometimes turned down one corner of a business card on visiting or meeting the party in order to note that a meeting took place. However, this can soil or otherwise damage the card, making it less suitable for future use.

There are, of course, various machines for indicating figures on papers by mean of stamping or perforating, some of which place a date on the papers. The prior dating machines which stamp a date on a paper rely on the use of ink, and therefore make a mark which can become illegible as a result of smearing or fading. The prior perforating machines are far too bulky to carry and can undesirably mutilate a portion of the card.

Thus, there is a need for a machine which can be conveniently used anywhere to permanently note dates on business cards, or the like.

SUMMARY OF THE INVENTION

Accordingly, it is an object of the present invention to provide an improved machine for noting a date on a calling card, business card or the like, which is conveniently carried with or received into a card case.

It is another object of the invention to provide a machine for impressing a date on a calling card.

It is another object of the invention to provide a dating machine capable of carving a date either in the order of the day, month and year or the order of the month, day and year.

It is a further object of the invention is to provide a dating machine having a perpetual calendar comprising type figures.

The above, and other objects of the present invention are achieved, according to a preferred embodiment thereof, by providing a base plate adapted to be carried with a card case, date impressing means comprising first, second and third date impressing elements carrying projections corresponding to the days, months and years of the calendar date, respectively, said elements mounted to said base plate for independent relative movement between different conditions of alignment of said projections to correspond to individual calendar dates, and means for pressing a card against said elements when said projections are in one of said conditions of alignment to form indentations in the card in the configuration of said projections, said indentations indicating said corresponding calendar date.

The dating machine according to the invention is pocketable and handy for carrying. It can be conveniently used anywhere and anytime that the necessity for noting a date arises. The dating machine of the invention can be carried together with a card case by attachment thereto or by being received therein.

Other objects and advantages of the invention will be described hereinafter.

BRIEF DESCRIPTION OF THE DRAWINGS

The present invention will be illustrated more fully by way of examples with reference to the accompanying drawings, in which.

DESCRIPTION OF THE PREFERRED EMBODIMENT

Figure 1:
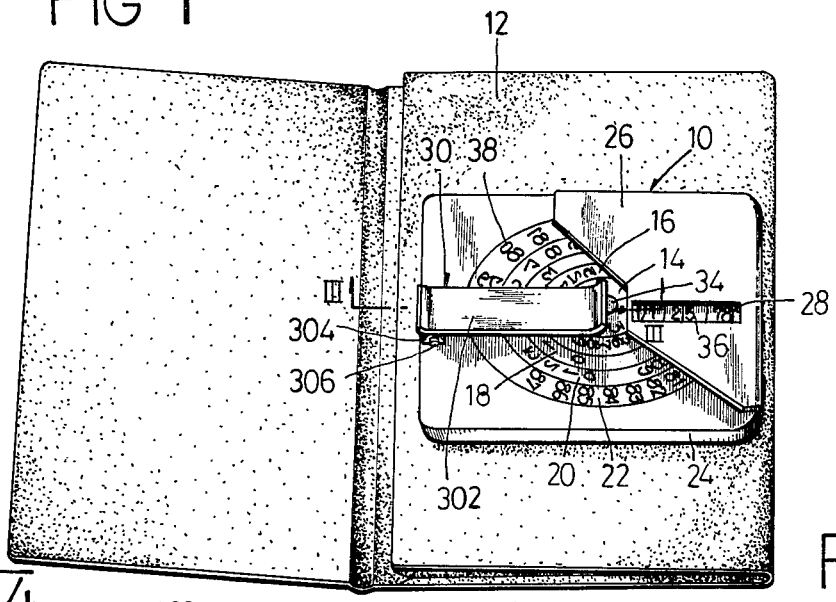
FIG. 1 is a perspective view of a dating machine constructed according to a first embodiment of the invention attached to a card case.
Figure 3:
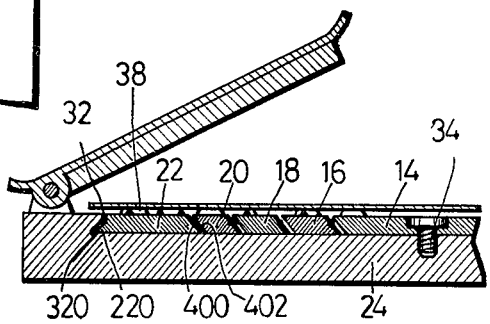
FIG. 3 is an enlarged partial sectional view taken along line III—III in FIG. 1.
Figure 2:
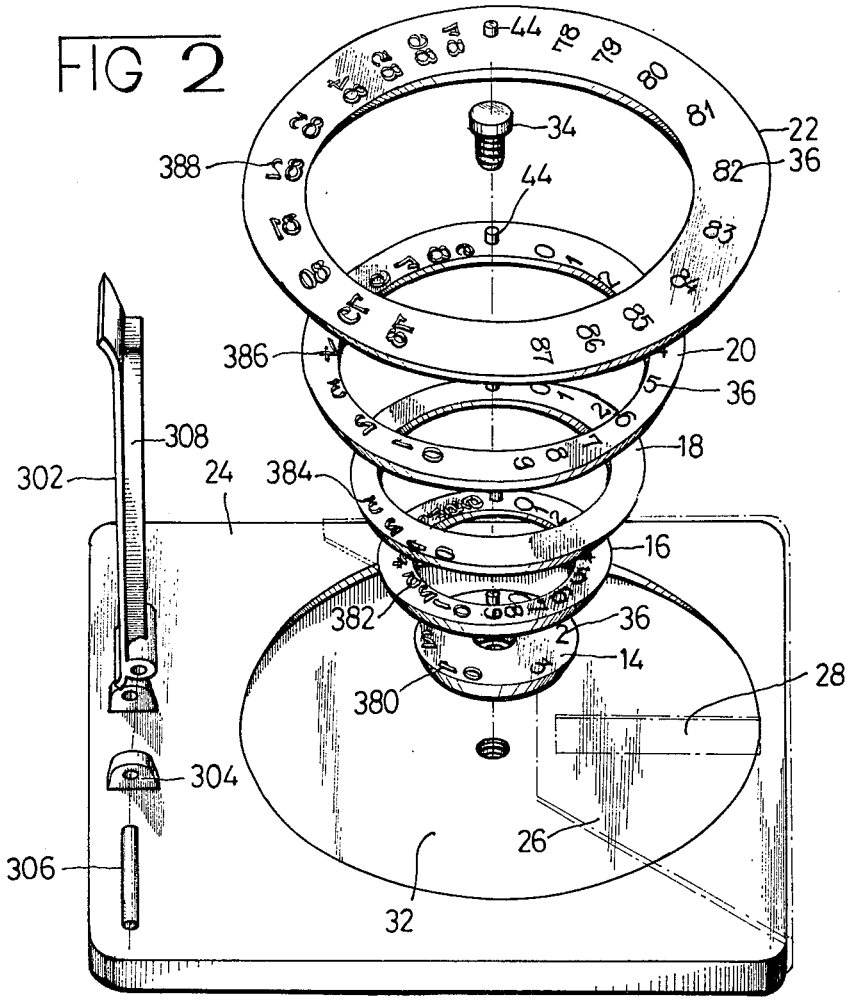
FIG. 2 is an enlarged perspective view of the dating machine of FIG. 1 in exploded form.

Referring now to the drawings, particularly to FIGS. 1 through 3, there is illustrated a dating machine according to the first embodiment of the invention. A dating machine 10 is attached to the inner surface of a card case 12 by gluing or otherwise securing a base plate 24 thereon. The base plate 24 may be approximately 53 mm long, 58 mm broad and 4 mm thick, in order to be receivable into the card case 12. The base plate 24 is provided with a circular recess 32 able to receive link plates 14, 16, 18, 20 and 22. A center pin 34 projecting from the center of the recess 32 mounts the innermost link plate 14 for rotation thereabout.

The inner diameters of respective link plates 14, 16, 18, 20 and 22 are slightly larger than the outer diameters of respective adjacent inner link plates. The link plates are concentrically positioned within the recess 32 in side-by-side relationship for rotation about one another and about the center pin 34. The outer diameter of the outermost link plate 22 is slightly smaller than that of circumference of the circular recess 32 in order to be received therein. The thickness of the respective link plates 14, 16, 18, 20 and 22 are adapted to the depth of the recess 32 such that the upper surfaces of the link plates are flush with the upper surface of the base plate 24.

As shown in FIG. 3, the recess 32 is formed with a tapered groove 320 adapted to receive a projection 220 provided on the outer surface of the outermost link plate 22. The radially outer surfaces of the link plates 14, 16, 18 and 20 and the radially inner surfaces of the link plates 16, 18, 20 and 22 are provided with similar interconnectable tapers 400 and 402 in order to restrain the respective link plates against axial movement.

Figure 4:
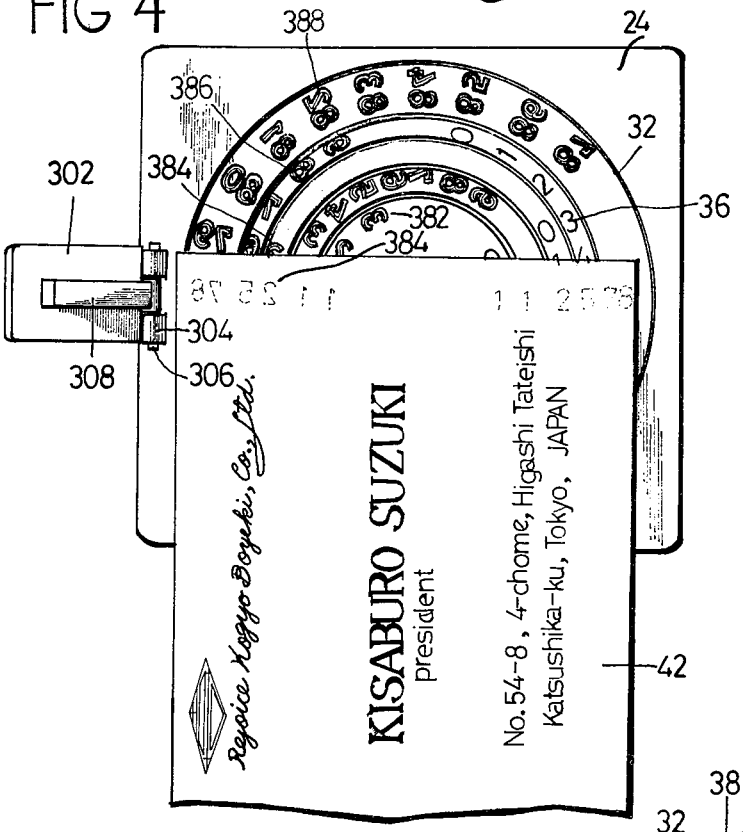
FIG. 4 is enlarged plan view of the dating machine of FIG. 1 with a business card in operative position thereon.

Each link plate 14, 16, 18, 20 and 22 is provided with projections in the form of aligned type figures 38 on the upper surface thereof. The respective type figures 38 project from the upper surface of the base plate 24 in order to form indentations in a card 42 forced thereagainst, as shown in FIGS. 3 and 4.

The type figures 380 on the innermost link plate 14 represent the figures "0" through "3", and the type figures 382 of the next link plately represent the figures "0" through "9". The combination of the type figures 380 and 382 indicates a day or a month of the designated date in the aligned condition. The type figures 384 and 386 of the link plates 18 and 20 are combined in the same manner as above, in order to indicate a month or a day of the date in the aligned condition. The types 388 of the outermost link plate 22 represent the figures "78" through "87" to indicate a year of the date. However, the outermost link plate 22, provided with two lines of types 388 along the circumference of the link plate 22 in side-by-side relationship, may otherwise comprise two separate concentric portions carrying aligned type figures "0" through "9" to make up a perpetual calendar.

The respective link plates 14, 16, 18, 20 and 22 are also provided with indication figures 36 written or carved on the upper surface of the base plate and positioned oppositely from the respective type figures 38. The type figures 38 are aligned to designate a particular date in combination at a date impressing portion by properly aligning the indication figures 36 opposite therefrom. A card may then be pressed against the type figures at the date impressing portion to form indentations on the card denoting the date. The alignment of the types 38 may be observed by viewing the indication figures 36 through an opening 28 in a cover element 26 which covers approximately half of the dating machine on the side opposite to the carving portion, as shown in FIG. 1.

A depressing means 30 having a depressing plate 302 is mounted to the base plate adjacent the side edge thereof. One end of the depressing plate 302 is pivotally secured to ears 304 projecting from the base plate 24 by a shaft 306. The depressing plate 302 is provided with a projection 308 on the inner surface thereof. The width of the projection 308 is approximately equal to the height of the types 38 so that only the types located at the carving portion are able to form identations in the card.

Preferably, the respective link plates 14, 16, 18, 20, and 22 are further provided with small projections 44, as shown in FIG. 2, for rotating respective link plates.

Before carving a date on a calling card, business card or the like 42, as shown in FIGS. 3 and 4, respective link plates 14, 16, 18, 20 and 22 are respectively rotated about one another to a condition wherein the designated date is formed by alignment of the type figures 38 at the carving portion. The alignment of the type figures is indicated by alignment of the indication figures 36, as observed through the opening 28 of the cover 26. The card 42 is then placed on the date carving portion and the depressing plate 302 is pivoted to engage the upper surface of the card 42. Application of a downward force to the depressing plate 302 thus causes the card to be forced onto the aligned type figures 38, forming an indentation indicating the date in the card.

Figure 5:
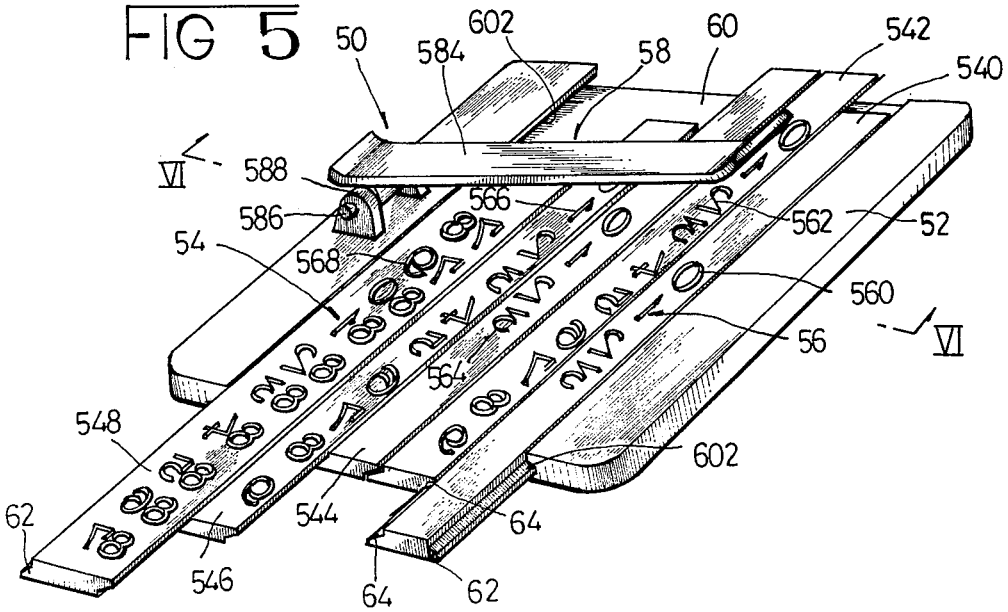
FIG. 5 is a perspective view of a dating machine according to a second embodiment of the invention.
Figure 6:
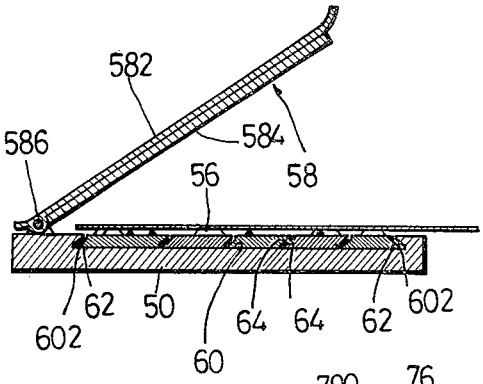
FIG. 6 is a sectional view taken along line VI—VI in FIG. 5'.

As shown in FIGS. 5 and 6, the dating machine may be embodied otherwise in accordance with the invention. In FIGS. 5 and 6, there is illustrated the second embodiment of the invention. A dating machine 50 comprises a base plate 52, sliding plates 54 having projections in the form of type figures 56 therein, and a depressing means 58 provided on the base plate 52 adjacent one side edge thereof. The base plate 52 is provided with a slot 60 extending longitudinally of the base plate 52. As shown in FIG. 6, both side edges of the slot 60 are provided with longitudinal grooves 602 for engagement with tapered edges 62 formed on the left side of the sliding plate 548 and the right side of the sliding plate 540. The remaining edges of the sliding plates 54 are formed of interfitting up-right tapers 64 retaining the sliding plates within the slot 60 while allowing them to slide freely thereby.

The type figures 560 extending from the upper surface of the sliding plate 540 represent the figures "0" through "3", and the type figures 562 projecting from the upper surface of the sliding plate 542 represent the figures "0" through "9". The type figures 560 and 562 indicate in aligned combination a day or a month of the designated date. The type figures 564 and 566 of the sliding plates 544 and 546 are combined in a manner similar to the above, for indicating a month or a day of the date. The sliding plate 548 is provided with aligned type figures 568 on the upper surface thereof, representing the figures "78" through "87".

A depressing means 58 comprises a depressing plate 582 having a projection 584 along the longitudinal center line thereof. The depressing plate 582 is pivotally secured at one end thereof to the base plate 52 by a shaft 586 carried by a pair of ears 588. Thus, the depressing plate 582 can be pressed toward the aligned type figures to form indentations representing a particular date in a card, as described above in relation to the embodiment of FIGS. 1-3.

It should be noted that, in this embodiment, the base plate 52 may be of a size similar to that of the first embodiment of the invention, in order to be received into or attached onto a card case.

Figure 7:
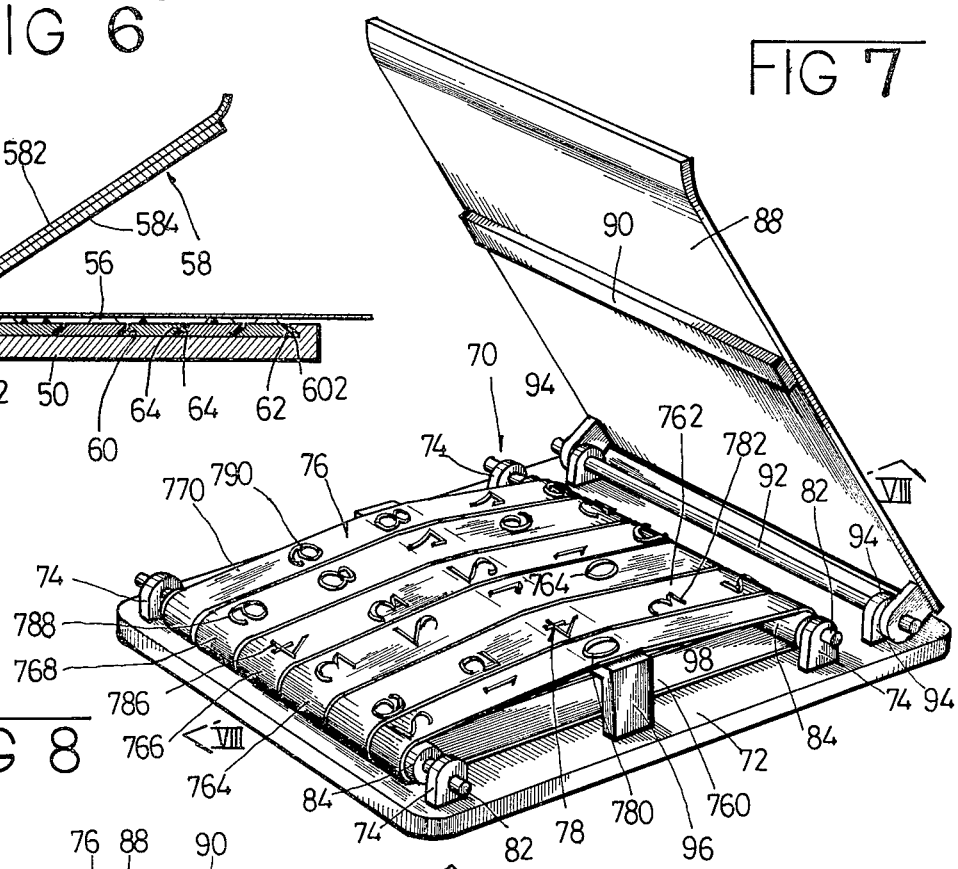
FIG. 7 is a perspective view of a dating machine according to a third embodiment of the invention.
Figure 8:
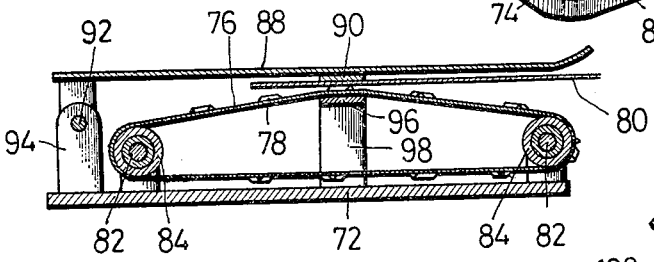
FIG. 8 is a sectional view taken along line VIII—VIII in FIG. 7.

In FIGS. 7 and 8, there is shown the third embodiment of the invention. A dating machine 70 comprises a base plate 72 having two pairs of ears 74 projecting from the outer surface thereof, sliding belts 76 made from flexible thin metallic plates having projections in the form of aligned type figures 78, and a depressing means provided on the base plate 72 depressing a card 80 onto the aligned type figures 78.

Each pair of ears 74 supports a shaft 82 with a roller 84. The sliding belts 76 are fitted around the rollers 84 for rotary movement thereabout. The type figures 780 project from the upper surface of the sliding belt 760 and represent the figures "0" through "3". The type figures 782 of the sliding belt 762 which is positioned adjacent the sliding plate 760, represent the figures "0" through "9". The type figures 780 and 782 indicate in combination a day or a month of a date. The types 784 and 786 provided on the upper surface of respective sliding belts 764 and 766 are combined in a manner similar to the above, for indicating a month or a day of the date. The types 788 and 790 provided on the sliding belts 768 and 770, respectively, represent the figures "0" through "9" and are combinable in a manner similar to the above for indicating a year of the date.

The base plate 72 is provided with a cover plate 88 having a projection 90 extending from its underside. The cover plate 88 is pivotally mounted to the base plate 72 by a shaft 92 mounted between a pair of ears 94 projecting outwardly from the base plate 72. The projection 90 is positioned on the cover plate 88 at a point engageable with a date carving portion of the base plate 74 where respective type figures 78 are aligned to form the designated date. The projection 90 functions as a depressing means for forcing the card 80 onto the aligned type figures 78 in order to form indentations on the card corresponding to the date. A stationary plate 96 is laterally attached to the upper surface of the base plate 72 to engage the inner surface of the sliding belts 76 adjacent the date carving portion. The stationary plate 96 provides the necessary backing to the sliding belts 76 as the indentations are formed. The stationary plate 96 is supported on the base plate 72 by legs 98 on both sides thereof.

Figure 9:
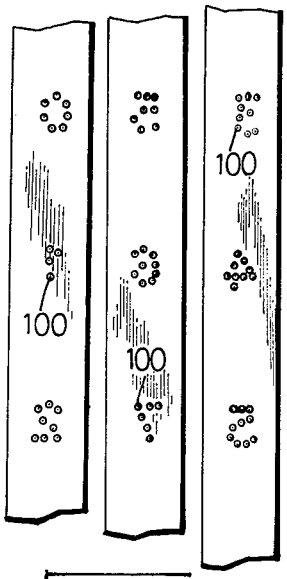
FIG. 9 is a partial plan view of date impressing elements constructed in accordance with the present invention.

It should be noted that, although the type figures in the preceeding embodiments are formed integrally, they may be formed otherwise; e.g., as shown in FIG. 9, the types may be formed as a plurality of small sharp-headed projections 100 in the desired configuration. The employment of the projections 100 may afford an advantage by reducing the force required to depress the card onto the aligned types. Thus, the force applied to the depressing means may be reduced.

Figure 11:
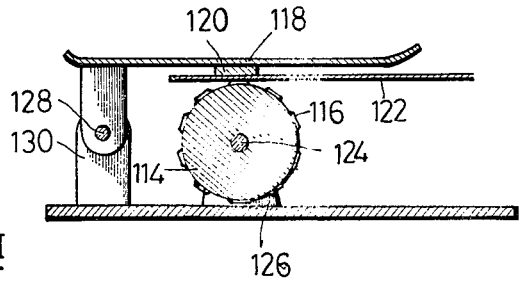
FIG. 11 is a sectional view taken along line XI—XI in FIG. 10.
Figure 10:
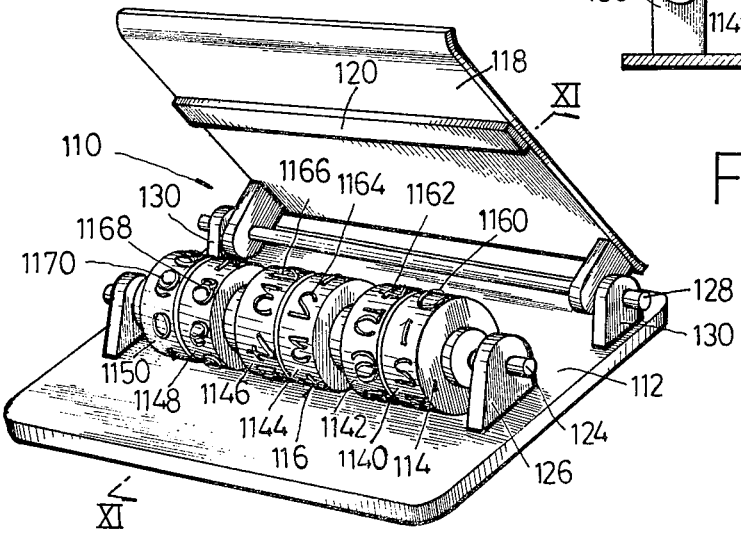
FIG. 10 is a perspective view of a dating machine according to a fourth embodiment of the invention.

In FIGS. 10 and 11, there is illustrated a dating machine 110 in accordance with the fourth embodiment of the invention. The dating machine 110 comprises a base plate 112, rollers 114 having type figures 116 aligned and projecting from the outer surface thereof, and a cover plate 118 having a projection 120 extending inwardly from the inner surface of the cover plate 118 and functioning as depressing means for forcing a card over the type figures 116 to form indentations therein.

The rollers 114 are mounted coaxially to a shaft 124 for rotation thereabout. Both ends of the shaft 124 are secured to ears 126 projecting from the base plate 112 adjacent the edges thereof. The type figures 1160 provided on the roller 1140 represent the figures "0" through "3". The type figures 1162 provided on the roller 1142 represent the figures "0" through "9". The type figures 1160 and 1162 in combination correspond to a day or a month of the designated date. The types 1164 and 1166 of the rollers 1144 and 1146 are combined in a manner similar to the above for forming a month or a day of the date. The type figures 1168 and 1170 of the rollers 1148 and 1150 are combined in a manner similar to the above and each represents figures "0" through "9", corresponding in combination to a year of the date.

The cover plate 118 is pivotally mounted to the base plate 112 through a shaft 128 which is mounted between a pair of ears 130 projecting from the base plate 112 adjacent one edge thereof. The projection 120 is positioned on the cover plate 118 at a point engageable with the top of the aligned rollers. Thus, the projection 120 functions as a depressing means for forcing a card onto the aligned type figures 116 in order to form indentations on the card in a manner similar to that described above.

Thus, it is apparent that there has been provided a novel dating machine which fulfills all of the objects and advantages sought therefor.

While specific embodiments of the invention have been shown and described in detail to illustrate the application of the principles of the invention, it will be apparent that the invention may be embodied otherwise without departing from such principles.

I claim:

1. A machine for impressing a date on calling cards, comprising:

a base plate having a circular recess;

a dial member mounted for rotation within the circular recess and having a series of concentric annular link plates relatively rotatable within a common plane, said link plates each having on one planar face thereof; a series of normal and reverse numerals arranged symmetrically relative to an axis for reading and impressing purposes, respectively, said link plates being adjustable rotatively to indicate a preselected date in combination at first and second diametrically opposed locations on said planar faces of said plates;

a cover plate superimposed on the base plate, said cover plate having a sight opening at said first location and a cutout portion which includes said second location;

depressing means pivotable relative to the base plate and against said impressing numerals at said second location;

whereby a card can be forced against said impressing numerals to impress said preselected date thereon, said date being visually indicated by said normal numerals at said first location.

2. The machine recited in claim 1 wherein the radially inner and outer portions of said annular link plates are provided with interconnecting tapers restraining the link plates against relative axial movement.

3. The machine recited in claim 2 wherein the periphery of said circular recess is provided with an undercut tapered groove for reception of a correspondingly tapered radially outer portion of the outermost link plate.

4. The machine recited in claim 2 wherein the circular recess and the innermost and outermost annular link plates are trapezoidal in cross section, the remaining annular link plates forming, in cross section, outwardly inclined parallelograms.

* * * * *